United States Patent [19]

Rydeen et al.

[11] 4,086,871

[45] May 2, 1978

[54] LUBRICATOR ROLL

[75] Inventors: Robert L. Rydeen, St. Paul; John D. Vandervort, Cottage Grove, both of Minn.

[73] Assignee: Minnesota Mining and Manufacturing Company, St. Paul, Minn.

[21] Appl. No.: 798,176

[22] Filed: May 18, 1977

[51] Int. Cl.[2] ..... G03G 13/20; G03G 15/20

[52] U.S. Cl. ..... 118/60; 29/121.5; 69/30; 101/367; 118/260; 432/60

[58] Field of Search ..... 101/367; 118/60, 70, 118/203, 260, 262; 432/60, 228; 222/332, 318, 424; 29/121.5; 69/30

[56] References Cited

U.S. PATENT DOCUMENTS

| | | | |
|---|---|---|---|
| 1,614,547 | 1/1927 | Elliott | 101/367 |
| 2,237,429 | 4/1941 | Harrington | 118/70 X |
| 3,718,116 | 2/1973 | Thettu | 118/60 X |
| 3,964,431 | 6/1976 | Namiki | 118/60 |

FOREIGN PATENT DOCUMENTS

| | | | |
|---|---|---|---|
| 580,370 | 7/1933 | Germany | 101/367 |

*Primary Examiner*—John P. McIntosh

*Attorney, Agent, or Firm*—Cruzan Alexander; Donald M. Sell; John C. Barnes

[57] ABSTRACT

Improved lubricator roll for uniformly applying low viscosity lubricant to surfaces such as fusing rolls used in copying or reproduction machines. The roll has a longitudinal array of apertures for dispensing low viscosity lubricant contained in the roll and a longitudinal, interior strip which scoops lubricant into an annular reservoir formed between the strip and the roll. The annular reservoir provides a head on the lubricant near the dispensing apertures so that lubricant is dispensed therefrom over approximately three-fourths of each revolution, regardless of the level of lubricant in the roll. The reservoir-forming strip also modulates the amount of lubricant present in the reservoir so that the roll apertures alternately dispense oil and vent the roll.

14 Claims, 6 Drawing Figures

LUBRICATOR ROLL

BACKGROUND OF THE INVENTION (1) Field of the Invention

This invention relates to lubricating apparatus, for example, to apparatus for lubricating fusing rolls used to fix toner-defined images in copying machines.

(2) Description of the Prior Art

Fusing systems in copying machines frequently use a heated fusing roll in conjunction with a backup roll. An advancing sheet of paper having toner applied to the surface in an electrophotographically-derived image pattern passes through the nip formed by the fusing roll and backup roll, where the image is fixed.

Offsetting of toner onto the fusing roll and concomitant sticking of the copy sheet to the fusing roll is a frequent problem in hot roll fusing processes. The result is degradation of the copy and decreased operating life for the fusing roll, as well as possible destruction of the copy and jamming of the machine. Offsetting and sticking can be alleviated by applying an elastomeric surface coating to the fusing roller to enhance toner release capability.

Release is also enhanced and the life of the roll extended by using a release lubricant such as silicone oil. Typically, the silicone oil release lubricant is applied to the fusing roll by a sponge-like and wick-like material which is immersed in a tank of silicone oil. Unfortunately, the use of such systems make it difficult to control the application of the silicone oil so that sufficient oil is applied to release the toner without staining the copy. Particularly after periods of inactivity, the silicone oil may build up excessively in the wick. Also, the wick tends to become clogged with toner and to lose effectiveness fairly quickly.

Various approaches have been used in attempting to improve the performance of wick-like applicators. For example, U.S. Pat. No. 3,718,116 to Raghulling A. R. Thettu; issued Feb. 27, 1973, uses an applicator roll to apply lubricant to a main wick contacting the fuser roll and uses an auxiliary wick to promote uniform application of the lubricant to the applicator. U.S. Pat. No. 3,831,553 to Raghulling A. R. Thettu; issued Aug. 27, 1974, utilizes a sponge inserted between the main wick, the auxiliary wick and the applicator roll of the aforementioned U.S. Pat. No. 3,718,116. A different approach is provided by U.S. Pat. No. 3,883,291, to Eugene F. Cloutier and Douglas P. Connolly; issued May 13, 1975, in that a wiper is applied directly to the fuser roll to remove excess release liquid applied by a sponge-like applicator. Also, the contact pressures of the wiper and the applicator against the fuser roll are varied to control the application of the liquid to the fuser roll and the effectiveness of the wiper.

U.S. Pat. No. 4,040,383 to Vandervort, assigned to Minnesota Mining and Manufacturing Company, teaches a non-wick-like, release lubricant applicator system which is durable and applies the release liquid uniformly, thus avoiding the problems associated with wick-like applicators and the necessity for resorting to complicating application systems for wick-like applicators.

The Vandervort apparatus comprises a lubricant-dispensing roll containing an internal supply of lubricant; an applicator roll for transferring lubricant from the dispenser roll to the fuser roll and for wiping the fuser roll; and a spreader roll for evenly distributing the lubricant on the applicator roll prior to the completion of transfer to the fuser roll. The dispenser roll has lubricant-dispensing apertures and a concentric inner cylinder which, during rotation of the roll, scoops lubricant contained therein into an annular reservoir formed between the roll and the inner cylinder. The reservoir provides a relatively constant head of lubricant so that the lubricant is dispensed uniformly over about 270° of each revolution, regardless of the oil level in the dispenser roll. A fixed vent tube communicates with the interior of the dispenser roll to equalize pressure therein with the ambient and prevent heat-induced pumping of the lubricant.

SUMMARY OF THE INVENTION

The present invention provides an improved lubricator roll for transferring liquid lubricant to a surface such as that of a fuser roll. The lubricator roll comprises a rotatable cylinder having an axial array of apertures and a relatively narrow vent strip fixedly mounted within the first cylinder for rotation therewith. The vent strip and its associated flanges extend along a short arcuate section defined by an interior angle of about 80°. The cylinder provides a first reservoir for liquid lubricant. The outer surface of the vent strip and the interior surface of the cylinder define a second reservoir for lubricant. The vent strip has a radially inward-extending flange which directs lubricant from the interior of the cylinder into the second reservoir and an outward-extending flange contacting the interior of the cylinder which closes the trailing end of the second reservoir. This arrangement provides discharge of the lubricant from the apertures of the cylinder over approximately three-fourths of the rotation of the lubricator roll. The vent strip has an axial array of holes aligned with the cylinder apertures which drain the second reservoir at the upper portion of the rotational path of travel of the lubricator roll and thereby provides a passageway for venting excess pressure through the cylinder apertures.

BRIEF DESCRIPTION OF THE DRAWING

The present invention will be described in greater detail with reference to the accompanying drawing wherein.

DESCRIPTION OF THE PREFERRED EMBODIMENT

Figure 2:
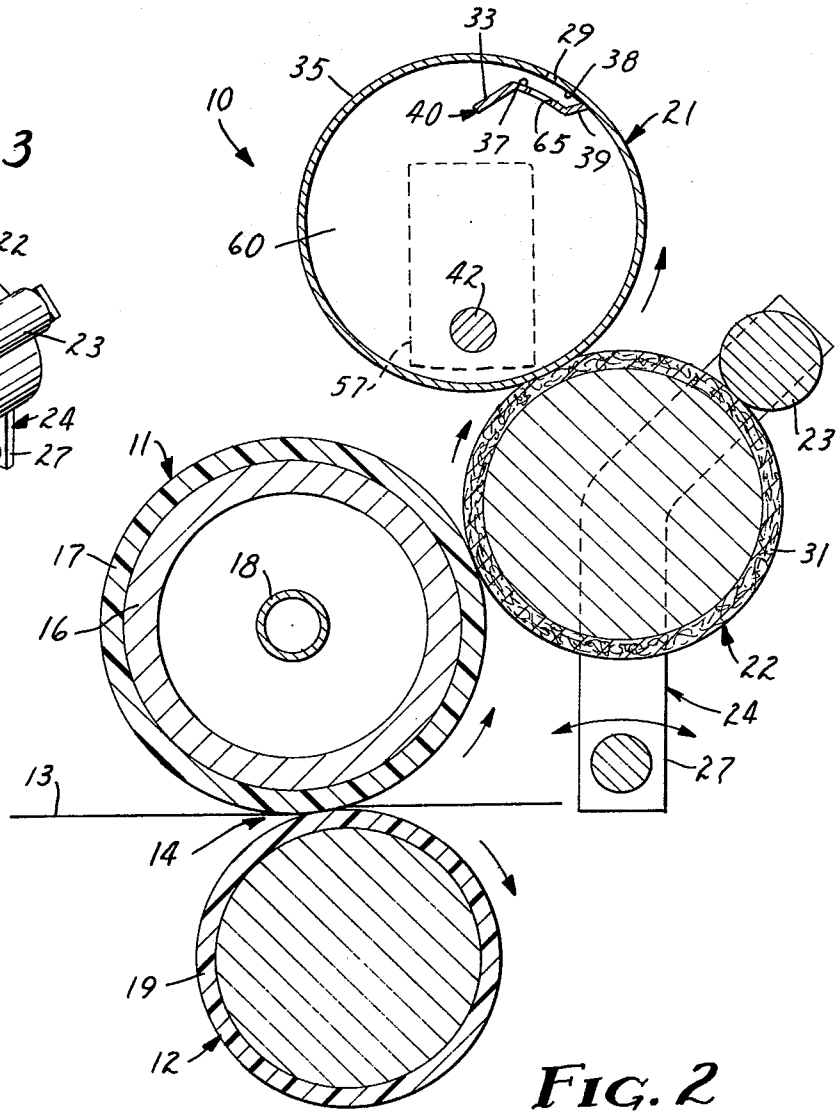
FIG. 2 is a cross-sectional view of the lubricating and cleaning apparatus shown in FIG. 1, taken along line 2—2 in FIG. 1.
Figure 1:
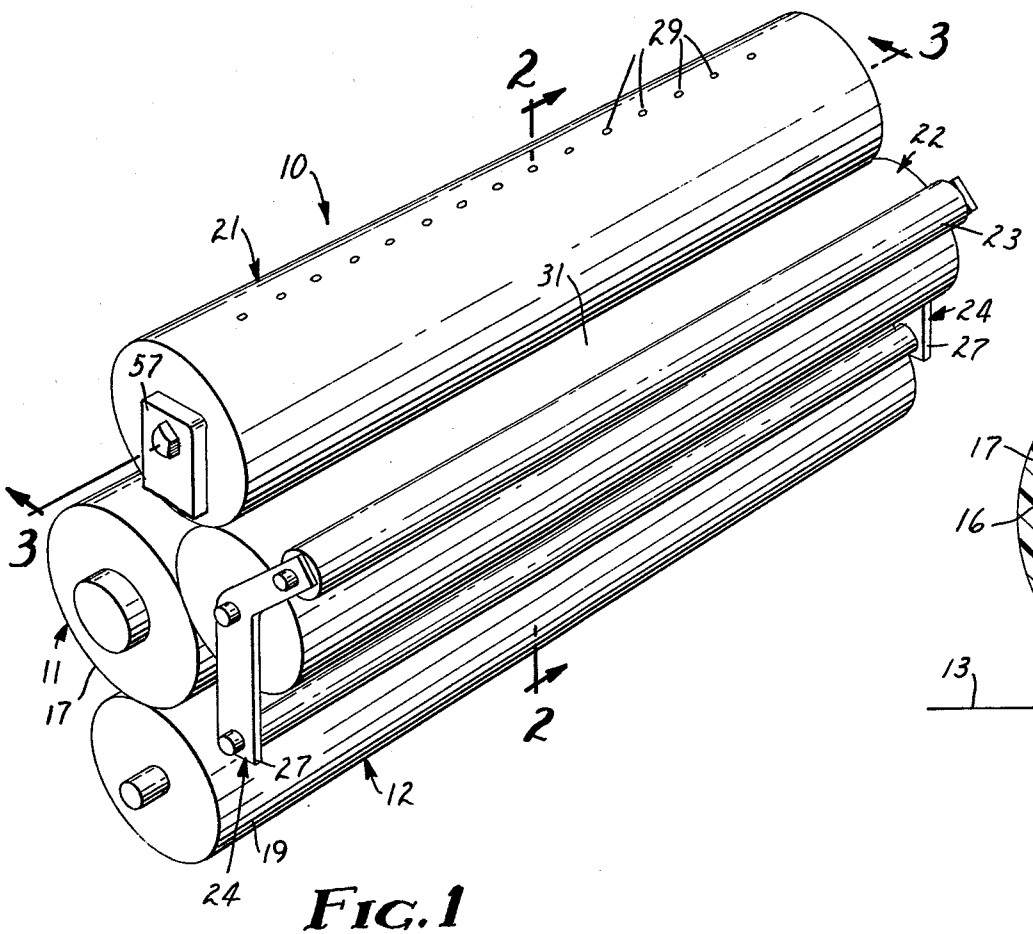
FIG. 1 is a perspective representation of a hot roll fusing assembly of a copying machine, which assembly utilizes lubricating and cleaning apparatus, including a lubricator roll which incorporates the principles of the present invention.

Referring now to FIGS. 1 and 2, there is shown a lubrication-dispensing or lubricator roll 21 that is utilized in lubricator-cleaner apparatus 10 of a hot roll fusing assembly. This application of the lubricator roll 21 is illustrative only and not limiting, for the lubricator roll has application wherever roll dispensing of low viscosity lubricant is utilized.

The general arrangement of the lubricator-cleaner apparatus 10 and the hot roll fusing assembly is that of aforementioned U.S. Pat. No. 4,040,383, to Vandervort. The hot roll fusing assembly is that of a copying machine and utilizes a heated fuser roll 11 and a nip roll 12. An advancing sheet of paper 13, having toner applied to the upper surface thereof in an electrophotographically-derived image, passes through nip 14 formed by the fuser roll 11 and the nip roll 12, where the toner image is fixed.

Referring further to FIG. 2, the illustrated fuser roll 11 comprises a metal portion 16 having an elastomeric surface coating 17. Heat is supplied by a lamp 18 mounted within the roll 11. The nip roll 12 also has an elastomeric surface coating 19. Typically, the elastomeric coatings are applied by spraying and are 0.038–0.064 mm. thick. The elastomeric fuser roll coating 17 functions as a release agent for preventing the toner image from offsetting onto the fuser roll preventing the copy paper 13 from sticking to the fuser roll.

Although any one of a number of elastomeric coatings could be used in the instant invention, it has been found that silicone rubbers have many desirable features which make them advantageous to use as fuser roll coatings. Silicone rubbers are chemically compatible with the release lubricant used on the fuser roll and they maintain their mechanical and chemical integrity under heat and pressure. Although silicone rubbers have proven operable in this invention, the invention is not limited solely to the use of silicone rubbers as the elastomeric coating.

As taught in the aforementioned Vandervort, U.S. Pat. No. 4,040,383, it is desirable to apply a toner release lubricant to the fuser roll 11 and to clean the roll. As shown in FIGS. 1 and 2, a lubricator-dispensing or lubricator roll 21 acts in conjunction with an applicator roll 22 and a spreader roll 23 to apply lubricant to and clean the fuser roll 11. Because silicone oil provides excellent lubricating qualities and is compatible with elastomeric surfaces, hereinafter the lubricant is considered to be silicone oil.

Referring further to the lubricating and cleaning apparatus 10 shown in FIGS. 1 and 2, the applicator roll 22 is mounted for rotational movement on a pair of angled brackets or arms 24—24. The brackets are mounted to the copier (not shown) for pivotal movement at first ends 27—27 thereof and rotatably mount the spreader roll 23 in frictional engagement with the applicator roll 22. The lubricator roll 21 is also mounted to the frame (not shown) of the copier, typically along longitudinal axis 28 (FIG. 1). As indicated by the arrows in FIGS. 1 and 2, the angled brackets 24—24 are pivotable by any suitable means (not shown), to bring the applicator roll 22 into simultaneous engagement with the fuser roll 11 and the lubricator roll 21.

In the illustrated exemplary arrangement, although certainly not the only satisfactory one, the fuser roll 11 and the applicator roll 22 can be operated by the same gear or belt drive system (not shown), while the lubricator roll 21 and the spreader roll 23 are rotated by frictional engagement with the applicator roll 22. In operation, with the applicator roll 22 rotatably engaging the fuser roll 11 and the lubricator roll 21, the rotation of the lubricator roll applies silicone oil from a reservoir 32 therein (FIG. 4) via a series of apertures 29—29 onto surface 31 (FIG. 2), of the applicator roll. The applicator roll surface 31 typically is a coating or covering of absorbent material, such as polyester felt. The spreader roll 23 provides a squeegee action which spreads the oil evenly over the applicator roll surface 31 for uniform application of the oil to the fuser roll 11. During this application, the absorbent surface 31 also removes any toner from the surface 17 (FIG. 1) of the fuser roll 11. The toner removal results from a differential in rotational speeds which induces a "wiping" action.

It is important to note that the fuser roll surface and applicator roll surface, although they are driven by the same gear or belt drive system, must turn at slightly different rotational speeds. This can be accomplished by having the applicator roll and fuser roll of slightly different diameter. The difference in surface speed imparts the wiping action on the fuser roll and cleans it. Although the difference in surface speed is not critical, it must be high enough to wipe the fuser roll but not so high as to abrade the elastomeric coating on the fuser roll.

The present invention relates to improved structure and function of the lubricator roll 21. The internal structure of the lubricator roll 21 is shown in FIGS. 2, 4, 5A and 5B, which are transverse cross-sectional representations, and in FIG. 3, which is a longitudinal cross-sectional representation. In particular, the lubricator roll 21 dispenses oil from the apertures 29—29 during about three-fourths of each rotation without surges caused by oil blow-out, despite the decrease in the quantity of silicone oil in reservoir 32 during use and increase in the oil vapor pressure within the lubricator roll. This uniform dispensing in turn facilitates uniform application of the oil to the surface 31 of applicator roll 22 (FIG. 2) and, hence, to surface 17 of the fuser roll 11.

The lubricator roll 21 comprises a circular cylinder 35 which has a longitudinal array of apertures 29—29 formed therein and a longitudinal vent strip 40 which is fixedly mounted within the cylinder 35 proximate to the array of apertures. Using the counter-clockwise direction of rotation shown in FIG. 4 as reference for the lubricator roll 21, an inward bent flange 33 at the leading edge of the vent strip 40 directs oil from reservoir 32 in the lubricator roll into an annular cavity defined by outer surface 37 of the vent strip 40 and interior surface 38 of the cylinder 35. An outward bent flange 39 at the trailing edge of the vent strip 40 engages interior surface 38 of cylinder 35 behind the apertures 29—29 (in the counter-clockwise sense) and closes the cavity so that the vent strip and surface 38 define a second reservoir 36 for oil.

The second reservoir 36 and the scooping action of leading edge flange 33 provide dispensing of oil at the apertures 29—29 for most of each revolution of the roll 21 and over a wide range of oil levels in the reservoir 32. Oil flow through apertures 29—29 is a function of gravitational force and therefore flow essentially occurs only when there is "head," *h*. However, due to the action of the flange 33 in scooping oil into the reservoir and the presence of the reservoir 36, sufficient head, *h*, is supplied to the oil near apertures 29—29 for dispensing oil over approximately three-quarters of each revolution. The rate at which the oil is dispensed decreases slightly as the level in reservoir 32 decreases, but dispensing continues over three-fourths of each revolution and the slightly decreased rate does not deleteriously affect the operation of the lubricator-cleaner apparatus 10.

Figure 3:
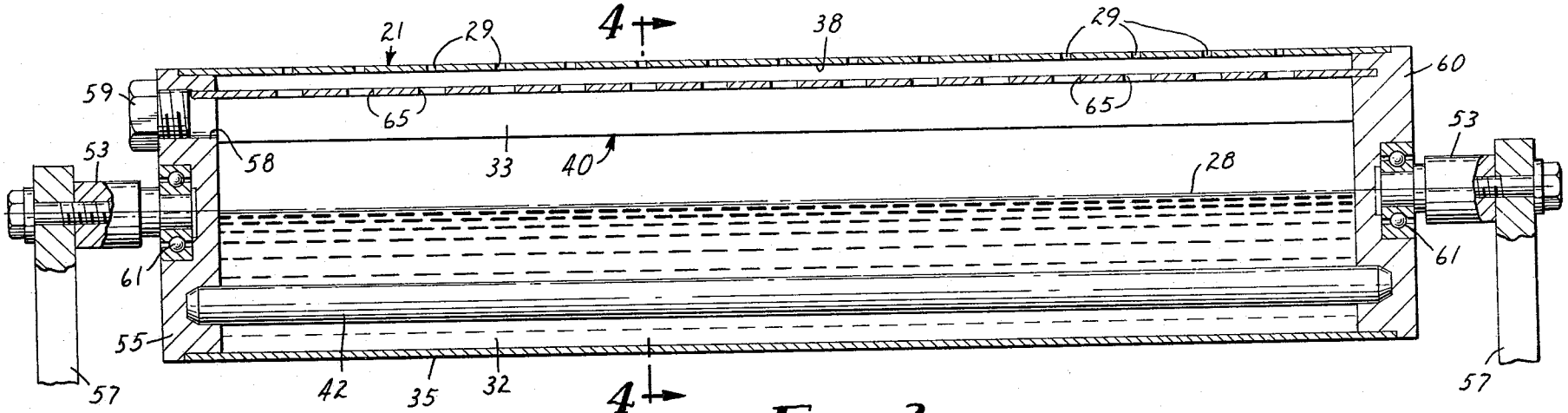
FIG. 3 is a longitudinal cross-sectional view of the lubricator roll of the present invention, taken along the line 3—3 in FIG. 1.

Referring to FIG. 3, the lubricator roll 21 is mounted on half shafts 53—53 with bearings 61—61. The half shafts are retained in support arms 57—57. This structure permits the roll to rotate about its longitudinal axis 28. A counterweight 42 is mounted in the interior of the lubricator roll 21 approximately on the opposite side of the longitudinal axis 28 from (diametrically opposite) the linear array of apertures 29—29. The counterweight is located and affixed by cavities in the end structures 55 and 60 for the cylinder 35. When the applicator roll 22 (FIG. 2) disengages the lubricator roll 21, the counterweight 42 normally brings the lubricator roll to rest with apertures 29—29 at the highest radial or top dead center position. With the apertures so positioned, oil leakage is prevented when the roll 21 is at rest.

Internal pressure, such as that caused by heat, can "pump" oil from the lubricator roll 21 regardless of the radial position thereof. To prevent this, Vandervort, U.S. Pat. No. 4,040,383, provides internal venting in the form of a fixed, L-shaped vent tube (not shown) which has one leg extending into the air space above the reservoir 32 of silicone oil and a second leg which extends coaxially with one of the fixed half shafts 53—53 which rotatably support the roll 21. This coaxial arrangement permits the vent to be fixed in an upright position to provide continuous venting through an opening in the one shaft and equalization of pressure with the ambient atmosphere.

According to the present invention, vent holes 65—65 in vent strip 40 provide a simple, yet very effective arrangement for venting and pressure equalization. One of the vent holes 65—65 is positioned approximately coaxially with each of the apertures 29—29, as shown in FIG. 3. It is preferred to locate vent holes 65—65 and apertures 29—29 evenly down the length of the roll. Even spacing dispenses the lubricant evenly across the surface of the lubricator roll. When the lubricant is transferred from the lubricator roll to the applicator roll, the squeegee action of the spreader bar aids in the uniform coating of the fuser roll. The number of apertures 29—29 and vent holes 65—65 is determined by the amount of oil which must be dispensed during each roll revolution. It is desirable to achieve the desired dispensing rate with a large number of relatively small holes to achieve uniformity. The actual size of apertures 29—29 is related to the viscosity of the lubricant used as well as the temperatures present in the oiler lubricant roll. In the absence of vent holes 65—65, surface tension would retain oil in reservoir 36 substantially throughout each revolution of travel of the lubricator roll 21. However, according to the present invention, the vent holes 65—65 drain oil from the reservoir 36 and vent the lubricator roll 21 to the atmosphere through apertures 29—29.

Figure 4:
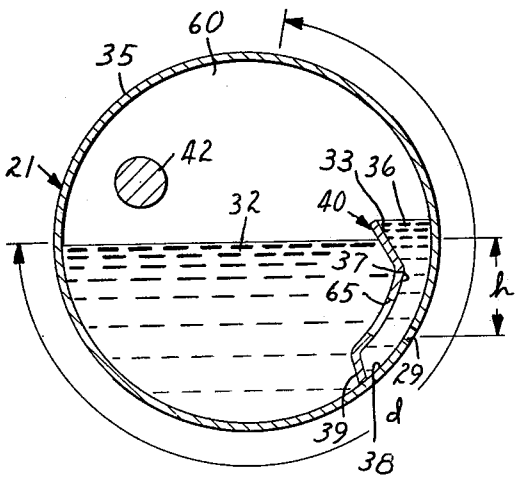
FIG. 4 is a transverse cross-sectional view of the lubricator roll of the present invention, taken along line 4—4 in FIG. 3 and illustrating the decreased effect of oil level on dispensing.

Referring to FIG. 4, the head, *h*, provides oil dispensing over about the lower three-fourths, *d*, of the rotational path of travel of the lubricator roll 21. Lubricant is initially discharged through apertures 29—29 when the apertures drop below the oil level in the reservoir in the cylinder. Oil dispensing stops as the apertures 29—29 approach the top dead center position. The dispensing range is shown as arcuate distance, *d* on FIG. 4.

Figure 5B:
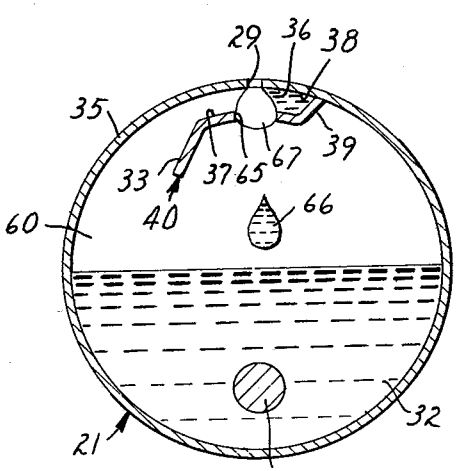
FIGS. 5A and 5B are transverse cross-sectional views of the lubricator roll of the present invention, similar to FIG. 4 illustrating the operation of the vent strip to provide pressure equalization.
Figure 5A:
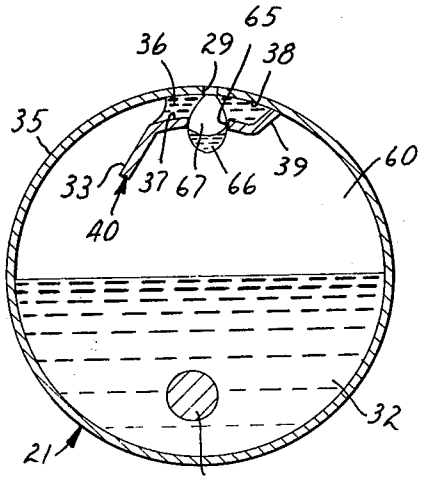

Referring to FIG. 5A, as the lubricator roll 21 approaches the top of its path of rotational travel, oil stored in reservoir 36 is compelled by gravity to fall through the vent holes 65, forming droplets 66 of oil which leave air bubbles 67 in their wake. (One aperture 29, vent hole 65, droplet 66, and bubble 67 are shown in FIGS. 5A and 5B.) As shown in FIG. 5B, the droplet falls into reservoir 32 almost immediately, due to its weight, leaving an expanded bubble 67 comprising a thin film of oil. In the absence of the vent holes 65, the mass of oil in reservoir 36 would preclude venting through apertures 29—29, at least until pressure is sufficient to overcome the relatively large amount of oil in the reservoir 36. However, with the vent holes 65—65 of the present invention, the enlarged thin wall bubble 67 is easily pierced by the internal pressure, allowing the interior to vent to the ambient and equalize the pressure. Also, because there is a relatively small amount of oil contained in the apertures 29—29 in the path of the venting air, there is very little blow-out of oil.

In short, the aperture 29-vent hole 65 arrangement uses the apertures 29—29 for both oil dispensing and venting. This arrangement prevents pressure-induced pumping by venting the lubricator roll 21 during each revolution of travel, and controlling the blow-out of oil during the venting. For sufficient venting capability without blow-out, the vent holes 65—65 are at least several times larger than the apertures 29—29. Preferably, for low viscosity lubricant such as silicone oil, the diameter of the vent holes is at least 10 times that of the apertures 29—29.

The optimal size of the vent holes depends principally on oil viscosity. If the holes are too large, then the scooping action of flange 33 will be insufficient to provide a head and reservoir for apertures 29—29. On the other hand, if the vent holes are too small, then they will not permit the oil contained within the reservoir 32 to drain back into reservoir 36. Vent holes 65—65 with a diameter of 8 mm. have been found to be a suitable size in combination with the other dimensions as will be later described in this specification.

To illustrate application of the present invention, exemplary lubricating-cleaning apparatus 10, FIG. 1, includes a lubricator roll 21 approximately 57 mm. in diameter and 246 mm. in length containing about 400 ml. of oil when filled. The oil is added via tapped bore 58 (FIG. 3) after backing out plug 59. Silicone oil of 500 centistoke viscosity is used. Fifteen apertures 29—29 which are approximately 0.56 mm. in diameter are uniformly spaced along the length of the roll 21. The applicator roll 22 is approximately 52 mm. in diameter and 264 mm. in length and has a polyester felt surface 31 (FIG. 2) of about 1.65 mm. thick. The width of the vent strip 40 in elevational view is approximately 30 mm., or occupies an arc defined by an interior angle of 80° with reference to the center of the roll. The vent holes 65—65 are 8 mm. in diameter. The spreader roll 23 is approximately 13 mm. in diameter and is made of steel. As is typical for copying applications, the fuser roll 11 (diameter 65 mm.; length 274 mm) is heated to temperatures of about 300° F. The normal operating temperature within the lubricator roller is 160° F or above. At these temperatures, the apparatus 10 provides lubrication and cleaning sufficient to virtually eliminate offsetting.

Lubricant loss by evaporation is about 0.02% of reservoir volume in a 24 hour period. Of course, lubricant consumption will depend upon the number of copies which are run. However, the interior reservoir which contains approximately 400 ml. of silicone oil lubricant will not need to be replenished for 25,000 copies.

Although any one of a number of materials could be used to manufacture the outer cylinder of the lubricator roll and its end caps, it has been found desirable to use clear molded polycarbonate plastic to provide a transparent structure which permits visual inspection of the reservoir level and to permit visual inspection of the vent holes to determine whether or not they are plugged by contaminants. It is also desirable to manufacture the end caps and the lubricator roll out of the same polycarbonate plastic material so that solvent bonding can be used to join these two elements. This results in a strong and leak-free joint which is not readily available with other construction methods.

Having described the present invention with reference to a preferred embodiment, it will be understood that possible modification may be made without departing from the spirit and scope of the present invention as recited in the appended claims.

We claim:

1. A roll for dispensing liquid contained within the roll during roll rotation, comprising:
- a cylinder having an interior and exterior surface, and a longitudinal axis;
- two end structures joined to said cylinder and adapted to permit rotation of said cylinder about its longitudinal axis;
- a first reservoir defined by said interior surface of said cylinder for holding a quantity of liquid;
- a strip mounted within said cylinder along said longitudinal axis having a first and second flanged portion;
- said first flanged portion contacting said interior surface of said cylinder to form a second reservoir;
- said second flanged portion is directed inward forming a scoop to feed liquid contained within said first reservoir to said second reservoir during rotation of the cylinder;
- said cylinder having a longitudinal array of apertures which communicate said exterior surface of said cylinder with said second reservoir;
- said strip having a longitudinal array of apertures therein, communicating said second reservoir with said first reservoir.

2. The roll of claim 1 wherein said cylinder and said strip are aligned such that apertures within said cylinder and apertures within said strip are concentric.

3. The roll of claim 1 wherein said cylinder and said strip are aligned such that apertures within said cylinder and apertures within said strip are concentric with a radial line drawn from said longitudinal axis of said cylinder.

4. The roll of claim 1 wherein the cross-sectional area of a strip aperture is at least one hundred times the cross-sectional area of a cylinder aperture.

5. The roll of claim 1, wherein the cross-sectional area of a strip aperture is approximately 196 times the cross-sectional area of the corresponding aperture in said cylinder.

6. The roll of claim 1 wherein said perforate apertures of said cylinder are evenly spaced along the length of said cylinder.

7. The roll of claim 1 wherein said perforate apertures of said cylinder are 15 in number.

8. The roll of claim 1 wherein said cylinder is constructed of a plastic material of sufficient transparency to allow visual determination of reservoir level and oiling function.

9. In a hollow closed cylinder rotatably mounted to a support for applying liquid to a surface in contact with the cylinder, the cylinder defining a reservoir for liquid and having apertures forming an array substantially parallel to the rotational axis of the cylinder for dispensing liquid contained in the cylinder, the improvement wherein the cylinder alternately dispenses liquid and vents internal pressure and further comprises:
- a strip mounted within the cylinder and defining a narrow annular cavity with the interior surface of the cylinder;
- said strip having an inward extending leading edge and an outward extending trailing edge which encloses the cavity behind the cylinder apertures; and
- said strip having an array of apertures, each strip aperture being proximate to corresponding cylinder aperture, and each strip aperture being at least ten times the diameter of the corresponding cylinder aperture.

10. The roll of claim 9, further comprising:
- counterweight means mounted within the roll diametrically opposite the array of cylinder apertures, for returning said array of cylinder apertures to the top dead center position.

11. In a reproducing machine including:
- a lubricator roll with an exterior cylindrical surface rotatably mounted on its longitudinal axis,
- an applicator roll having an absorbent material surface rotatably mounted in frictional engagement with said lubricator roll,
- a spreader roll rotatably mounted in frictional engagement with said applicator roll, for squeezing said absorbent material surface of said applicator roll,
- a heated fuser roll with an elastomeric surface rotatably mounted in live contact with said applicator roll,
- drive means for rotating said applicator roll and said fusing roll at a speed differential sufficient to cause wiping of said elastomeric surface by said absorbent material surface,
- the improvement wherein the lubricator roll comprises:
- a cylinder with a hollow interior forming a first reservoir for holding a liquid,
- a strip mounted in said hollow interior of said cylinder in close proximity to form a second annular reservoir,
- scoop means attached to said strip for filling said second annular reservoir from said first reservoir during rotation of said cylinder,
- said cylinder having a multiplicity of apertures communicating said exterior surface of said cylinder with said second annular reservoir for alternately dispensing liquid and venting said hollow cylinder,
- said strip having a multiplicity of apertures proximate to corresponding cylinder apertures for draining said second annular reservoir into said first reservoir, when said cylinder rotates to the uppermost position in its path of rotation.

12. The roll of claim 11 wherein said perforate apertures of said cylinder are evenly spaced along the length of said cylinder.

13. The roll of claim 11 wherein said perforate apertures of said cylinder are fifteen in number.

14. The roll of claim 11 wherein said cylinder is constructed of a plastic material of sufficient transparency to allow visual inspection of reservoir level and oiling function.

* * * * *